United States Patent [19]

Nagao et al.

[11] Patent Number: 4,618,099

[45] Date of Patent: Oct. 21, 1986

[54] ELECTRIC SPRAY

[75] Inventors: Tadasu Nagao; Shigeharu Sayama, both of Fukuoka, Japan

[73] Assignee: Kyushu Hitachi Maxell, Ltd., Fukuoka, Japan

[21] Appl. No.: 753,971

[22] Filed: Jul. 11, 1985

[30] Foreign Application Priority Data

Jul. 13, 1984 [JP] Japan ..... 59-106730[U]
Aug. 10, 1984 [JP] Japan ..... 59-123301[U]
Jan. 12, 1985 [JP] Japan ..... 60-3606

[51] Int. Cl.[4] ..... B05B 9/043

[52] U.S. Cl. ..... 239/332; 222/333; 222/470; 222/471; 239/378

[58] Field of Search ..... 239/332, 378; 222/333, 222/471, 474, 470

[56] References Cited

U.S. PATENT DOCUMENTS 3,901,449 8/1975 Bochmann ..... 239/332
3,904,116 9/1975 Jones et al. ..... 239/332 X

FOREIGN PATENT DOCUMENTS 72214 6/1978 Japan ..... 239/332

*Primary Examiner*—Andres Kashnikow
*Attorney, Agent, or Firm*—Birch, Stewart, Kolasch & Birch

[57] ABSTRACT

An electric spray including a spray casing having a grip formed with a recess, a tank mounted on the spray casing, a nozzle member fitted detachably into the recess and a slide switch mounted slidably on the grip. The spray casing accommodates a pump and a motor for driving the pump, while the slide switch is formed with a hollow for receiving the nozzle member so as to be at least partially exposed outwardly when the nozzle member has been received by the hollow.

7 Claims, 31 Drawing Figures

9
9b
9a
7
45
30
20
K2
20a
1
7
7
25
2
28

ELECTRIC SPRAY

BACKGROUND OF THE INVENTION

The present invention generally relates to an electric spray and more particularly, to a battery cover for covering a battery opening for interchange of batteries acting as a power source of the electric spray and a switch button for energizing and deenergizing the electric spray, which are employed in the electric spray.

Conventionally, electric sprays used for gardening, etc. are generally each composed of a spray casing having a pump, a motor for driving the pump, etc. accommodated therein, and a tank containing water or chemical liquid, etc. In the known electric sprays, the water or the chemical liquid in the tank is sucked up by the pump so as to be fed to a nozzle such that the water or the chemical liquid is spread over trees or flowers from the nozzle. In the known electric sprays of this kind, it has been a common practice that batteries acting as the power source are accommodated in the spray casing such that the motor for driving the pump is actuated by the batteries in view of the operability or efficiency of the spreading operations. Generally, in the case where the spreading operations are performed by using the known electric sprays, it is usually impossible to shield an outer peripheral face of the spray casing from the water or the chemical liquid. In the known electric sprays, a battery opening for allowing interchange of the batteries is formed on the outer peripheral face of the spray casing so as to be exposed outwardly and a cover member for covering the battery opening is detachably mounted on the outer peripheral face of the spray casing. Thus, the known electric sprays are inconvenient in that the water or the chemical liquid penetrates into the spray casing through a gap between the cover member and the outer peripheral face of the spray casing, thereby resulting in corrosion or deterioration of the batteries, contact plates for the batteries, etc. Furthermore, the known electric sprays have been disadvantageous in that the cover member is brought into contact with branches of the trees or other articles during the spreading operations or transport of the known electric sprays, thus resulting in frequent damage to the cover member.

Furthermore, in order to facilitate fabrication of the spray casing, there has been proposed an electric spray in which a pair of split half portions for the spray casing are molded separately from each other and then are coupled with each other by using fastening members so as to form the spray casing. This prior art electric spray has such a drawback that since the gap between the split half portions increases after its long-term operation, the water or the chemical liquid penetrates into the spray casing through the gap so as to reach terminal plates, etc. provided in the spray casing, thereby resulting in corrosion of the terminal plates, etc. In the prior art electric spray, although the central portion of the spray coating is inferior in strength, it is geometrically difficult to secure, at the central portion of the spray casing, the split half portions to each other by using screws due to its restricted space resulting from provision of the pump, the motor, etc. in the spray casing. Therefore, the prior art electric spray has such a disadvantage that the central portion of the spray casing is liable to be vibrated by the pump, the motor, etc. accommodated in the spray casing as compared with the opposite side portions of the spray casing, thereby resulting in unstable operation of the prior art electric spray.

Moreover, conventionally, in electric sprays, it has been generally so arranged that a switch button is provided on the grip in view of the operability and is operated by a finger of the operator's one hand holding the grip while the electric spray is being carried by holding the grip such that a nozzle unit detached from the grip is held by the other hand of the operator. Therefore, the known electric sprays have such an inconvenience that two hands of the operator are required to be used in order to operate the known electric sprays.

SUMMARY OF THE INVENTION

Accordingly, an essential object of the present invention is to provide an electric spray equipped with an improved battery cover for covering batteries acting as a power source of the electric spray, in which chemical liquid or water is prevented from penetrating into the spray casing through a battery opening for interchange of the batters or through a gap between a pair of split half portions constituting the spray casing.

In order to accomplish this and other objects of the present invention, there is provided, in one aspect of the present invention, an electric spray comprising a spray casing which accommodates therein a pump, a motor for driving the pump and a battery acting as a power source of the electric spray and a tank which is mounted on the spray casing, the spray casing having a wall confronting the tank such that a battery opening for allowing interchange of the battery is formed on the wall. Thus, in accordance with the present invention, when the spray casing has been mounted on the tank, the battery opening covered by the battery cover is shielded by the tank, so that it becomes possible to prevent the chemical liquid or water from penetrating into the spray casing through the battery opening.

Furthermore, in order to accomplish the above described object of the present invention, there is provided, in another aspect of the present invention, an electric spray comprising a spray casing which accommodates therein a pump, a motor for driving the pump and a battery acting as a power source of the electric spray and is formed by a pair of split half portions coupled with each other and a battery cover for covering the battery, the spray casing being formed, at a coupling portion between the split half portions, with a retainer member for supporting the battery cover, the battery cover being mounted on the spray casing through engagement of the battery cover with opposite sides of the retainer member. Thus, in accordance with the present invention, coupling strength for coupling the split half portions with each other is increased at the central portion of the spray casing, at which central portion it is difficult to secure the split half portions to each other by using screws. Moreover, in accordance with the present invention, since the retainer member is provided adjacent to the bottom of the spray casing, the retainer member is not likely to be subjected to an external force, so that the battery cover is not readily disengaged from the retainer member and thus, it becomes possible to positively couple the split half portions with each other.

Meanwhile, another important object of the present invention is to provide an electric spray equipped with an improved switch button, in which a grip of the electric spray acts also as a mounting portion of a nozzle unit and the grip is held by one hand of an operator such that the switch button can be turned on and off by a finger of the one hand holding the grip when the nozzle unit has been not only mounted but also detached from the grip.

In order to accomplish this object of the present invention, an electric spray embodying the present invention comprises a spray casing which accommodates therein a pump and a motor for driving the pump, said spray casing including a grip formed with a recess which is defined by opposite side wall portions of the grip, a tank which is mounted on the spray casing, a nozzle unit which is connected with the pump and is detachably engaged with said recess, and a slide switch button which extends from the recess to at least one of the opposite side wall portions of the grip. Thus, in accordance with the present invention, when the nozzle unit has been not only mounted on but detached from the grip, it becomes possible to slidably operate the switch button easily with a finger of one hand holding the grip.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
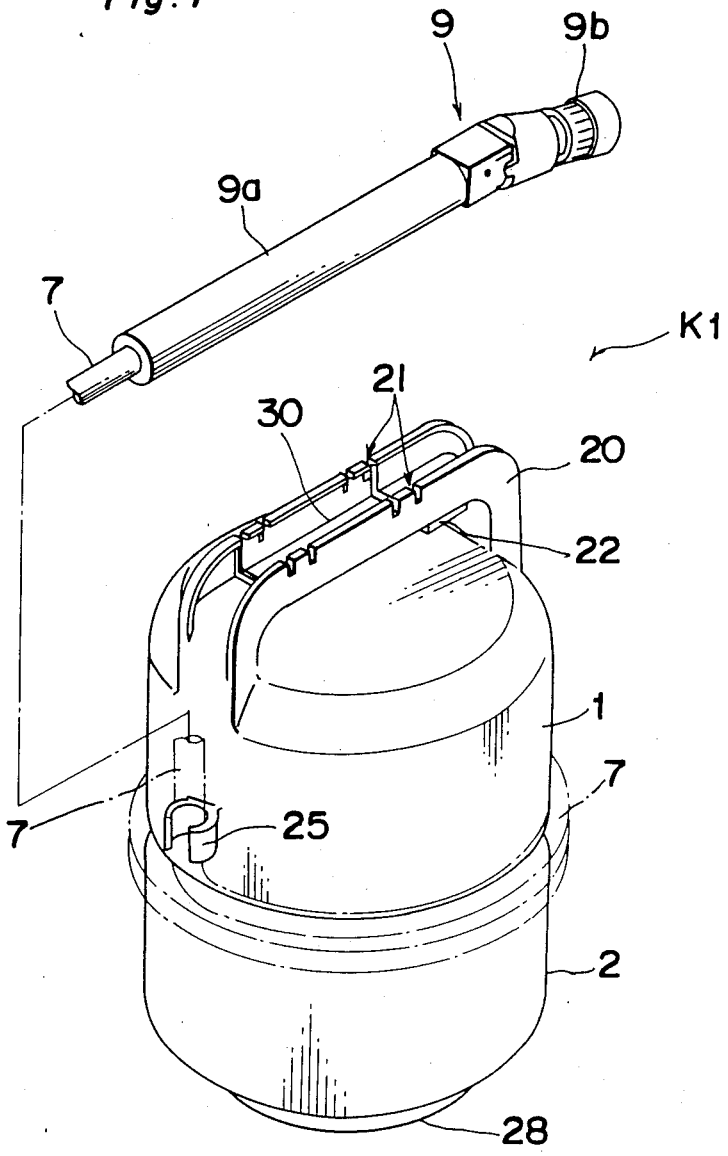
FIG. 1 is a perspective view of an electric spray according to a first embodiment of the present invention.
Figures 2, 3:
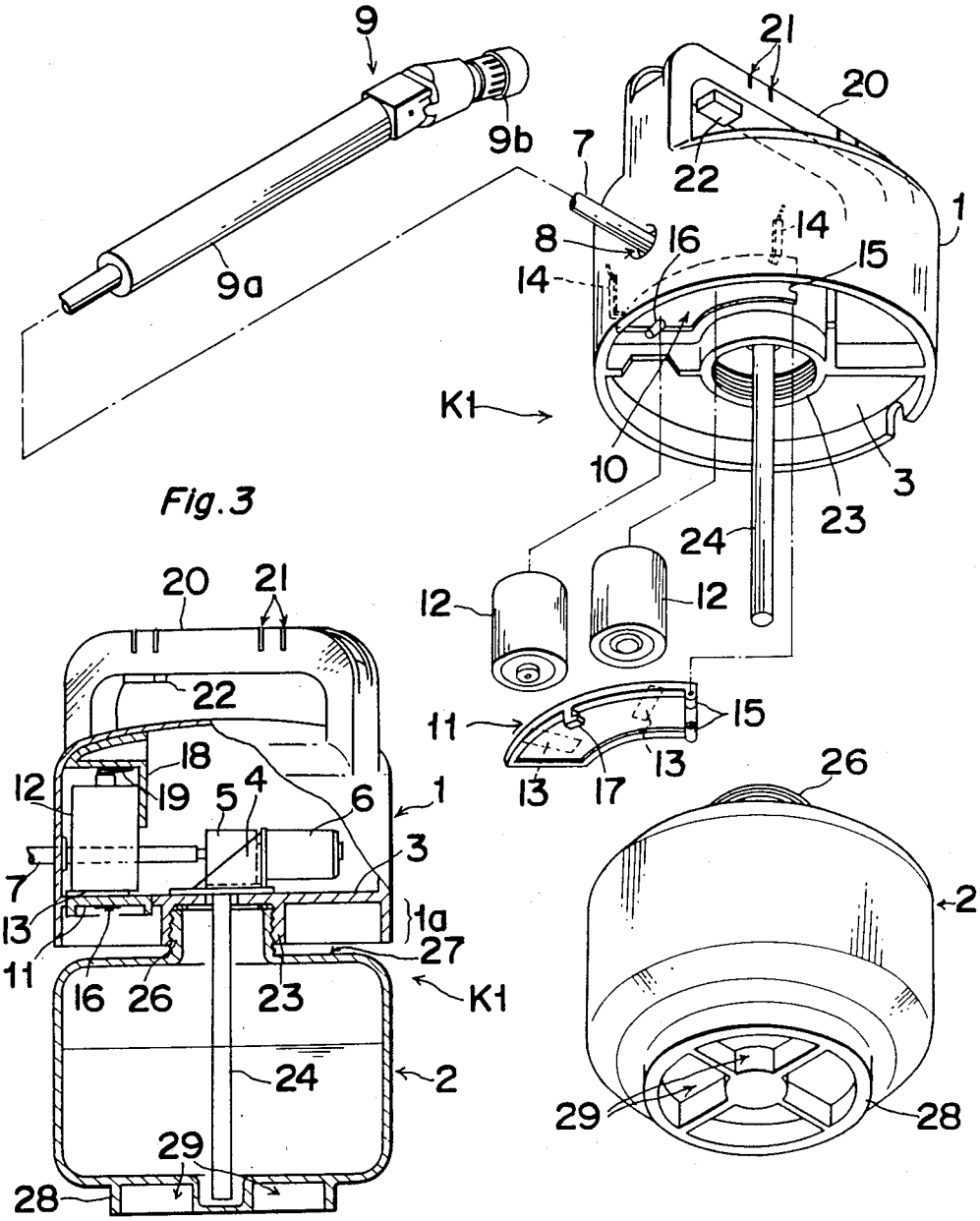
FIG. 2 is an exploded perspective view of the electric spray of FIG. 1.
FIG. 3 is a cross-sectional view of the electric spray of FIG. 1.

Referring now to the drawings, there is shown in FIGS. 1 to 3, an electric spray K1 according to a first embodiment of the present invention. The electric spray K1 includes a spray casing 1 of substantially cylindrical shape and a substantially cylindrical tank 2 which is detachably mounted on a lower portion of the spray casing 1. The spray casing 1 is formed, at a bottom portion thereof, with a bottom wall 3. A frame 4 is provided at a central portion of an upper face of the bottom wall 3 such that a pump 5 and a motor 6 for driving the pump 5 are mounted on the frame 4. The bottom wall 3 is slightly upwardly deviated from a lower end of the spray casing 1. Thus, a lower side wall portion 1*a* of a side wall of the spray casing 1, which is disposed below the bottom wall 3, acts as a shielding member for preventing foreign matter from penetrating between the spray casing 1 and the tank 2.

Figure 4:
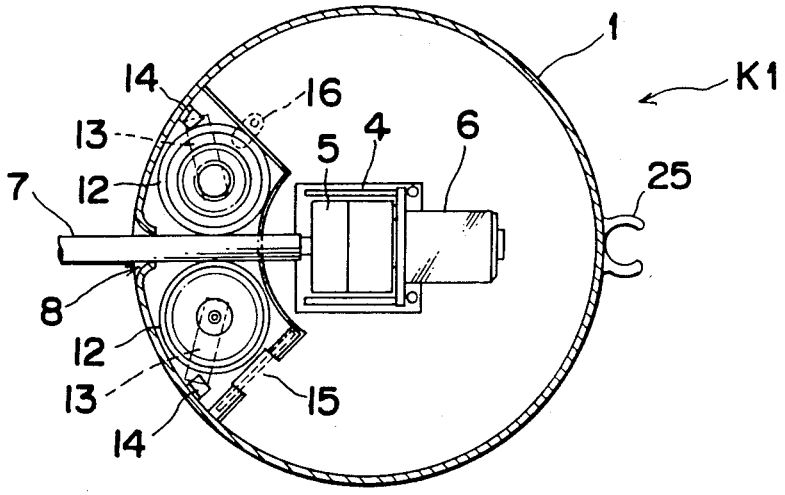
FIG. 4 is a top plan view of the electric spray of FIG. 1.

The spray K1 further includes a flexible tube 7 made of flexible vinyl, etc. The tube 7 is connected, at one end thereof, with the pump 5 and is led out of the spray casing 1 through a tube outlet 8 formed on the side wall of the spray casing 1, as shown in FIG. 4. The tube 7 is further connected, at the other end thereof, with a nozzle unit 9. The nozzle unit 9 is constituted by a tubular grip portion 9*a* and a nozzle portion 9*b* coupled flexibly or rotatably with a distal end of the grip portion 9*a*.

Furthermore, the spray K1 includes two batteries 12 acting as a power source of the spray K1. An arcuate battery opening 10 for allowing interchange of the batteries 12 is formed on the bottom wall 3. An arcuate battery cover 11 for covering the battery opening 10 is pivotally attached to the bottom wall 3 by a fastening member 16 so as to be pivoted about a hinge 15. The batteries 12 are accommodated in the spray casing 1 so as to be placed on the battery cover 11. Dry cells, rechargeable batteries, a battery package unit composed of a plurality of batteries, etc. can be employed as the batteries 12. Two contact plates 13 are placed on the battery cover 11 so as to be, respectively, connected to two terminal plates 14 extending on the inner face of the side wall of the spray casing 1. A knob 17 to be grasped by fingers of an operator for pivoting the battery cover 11 is formed on the lower face of the battery cover 11. A retainer frame 18 for retaining the batteries 12 is provided at an upper portion in the spray casing 1. Two contact plates 19 are attached to the retainer frame 18 such that each of the batteries 12 is interposed between each of the contact plates 13 and each of the contact plates 19.

Figure 5:
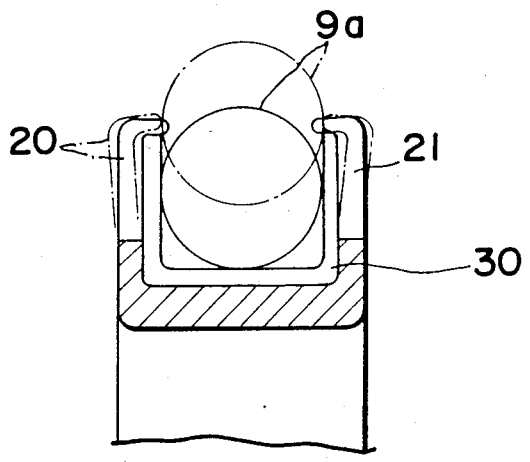
FIG. 5 is an enlarged cross-sectional view of a grip employed in the electric spray of FIG. 1.

Moreover, an elongated grip 20 is formed on a top wall of the spray casing 1 so as to extend, above top wall of the spray casing 1, between opposite sides of the spray casing 1. The grip 20 is formed with a longitudinally extending recess 30 as as to have a U-shaped cross section as shown in FIG. 5. In order to impart slight elasticity to the grip 20, the grip 20 is further formed with a plurality of slits 21. When the spray K1 is not in use, the nozzle unit 9 is retained by the grip 20 by elastically and detachably fitting the grip portion 9*a* into the recess 30. A switch button 22 is provided at a front portion of the lower face of the grip 20. A coupling pipe 23 formed with an internal thread is provided at a central portion of the lower face of the bottom wall 3. A suction hose 24 is extended from the pump 5 into the tank 2. A tube hook 25 is provided at a lower portion of the outer face of the side wall of the spray casing 1. When the spray K1 is not in use, the tube 7 is wound between the spray casing 1 and the tank 2 and is further brought into engagement with the tube hook 25 as shown by one-dot chain lines in FIG. 1 such that the nozzle unit 9 is retained by the grip 20 through fitting of the grip portion 9*a* into the recess 30. Meanwhile, a screw pipe 26 formed with an external thread is provided at a central portion of an upper face 27 of the tank 2. The tank 2 is detachably coupled with the spray casing 1 through threaded engagement of the screw pipe 26 with the coupling pipe 23. The tank 2 is formed, at its bottom portion, with a base 28. The base 28 is formed, on its bottom face, with a plurality of hollow portions 29. The tank 2 is mounted on or detached from the spray casing 1 by rotating the tank 2 through insertion of finger tips of the operator into the hollow portions 29. When the tank 2 has been coupled with the spray casing 1, the battery opening 10 confronts the upper face 27 of the tank 2 as shown in FIG. 3. At this time, foreign matter is prevented by the lower side wall portion 1*a* of the spray casing 1 from penetrating between the spray casing 1 and the tank 2.

Thus, by the above described arrangement of the spray K1 in which the battery opening 10 is formed on the bottom wall 3 of the spray casing 1 and the bottom wall 3 confronts the tank 2, various advantages can be obtained. Namely, generally, when water or chemical liquid is spread over flowers or trees by electric sprays, it is usually impossible to shield the spray casing from the water or the chemical liquid. In the prior art electric sprays, since the battery opening is formed on the outer peripheral face of the spray casing so as to be exposed outwardly, such an undesirable phenomenon readily takes place that the water or the chemical liquid penetrates into the spray casing through a gap between the cover member and the outer peripheral face of the spray casing, thereby resulting in corrosion or deterioration of the batteries, the contact plates for the batteries, etc. provided in the spray casing as described earlier. On the other hand, in the electric spray K1 of the present invention, since the battery opening 10 is formed on the bottom wall 3 of the spray casing 1 and the bottom wall 3 confronts the tank 2, the battery opening 10 is completely shielded by the tank 2 when the spray casing 1 and the tank 2 have been coupled with each other. Therefore, even if the water or the chemical liquid splashes on the spray casing during the spreading operations, it becomes possible to positively prevent the water or the chemical liquid from penetrating into the spray casing 1 through the battery opening 10. Furthermore, since there is no possibility that the water or the chemical liquid penetrates into the spray casing 1 through the battery opening 10, the battery cover 11 is not necessarily required to be of watertight construction and thus, can be simplified in construction. Moreover, in accordance with the present invention, such an undesirable phenomenon does not take place that the battery cover 11 is damaged through its contact with branches of the trees or other articles. It is to be noted that the battery cover 11 for covering the battery opening 10 is of pivotal mounting type in this embodiment, but can be of other mounting types such as slide mounting type, fit mounting type, etc.

Figure 6:
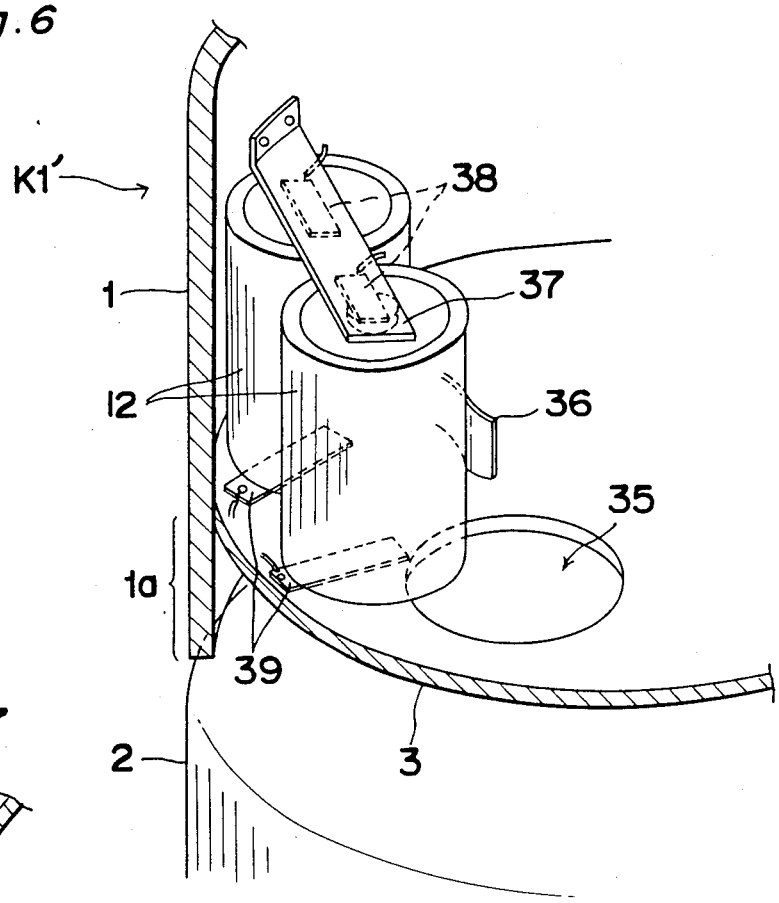
FIG. 6 is a fragmentary perspective view of an electric spray which is a modification of the electric spray of FIG. 1.
Figure 7:
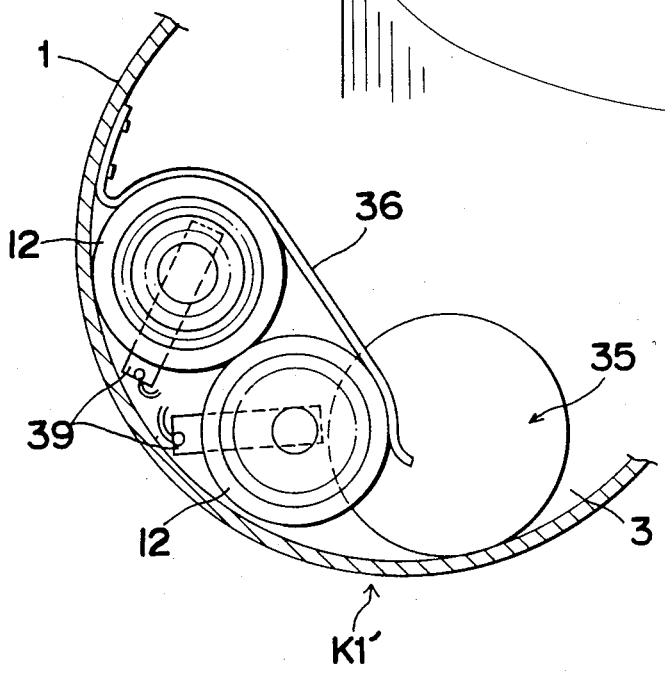
FIG. 7 is a fragmentary top plan view of the electric spray of FIG. 6.
Figure 8:
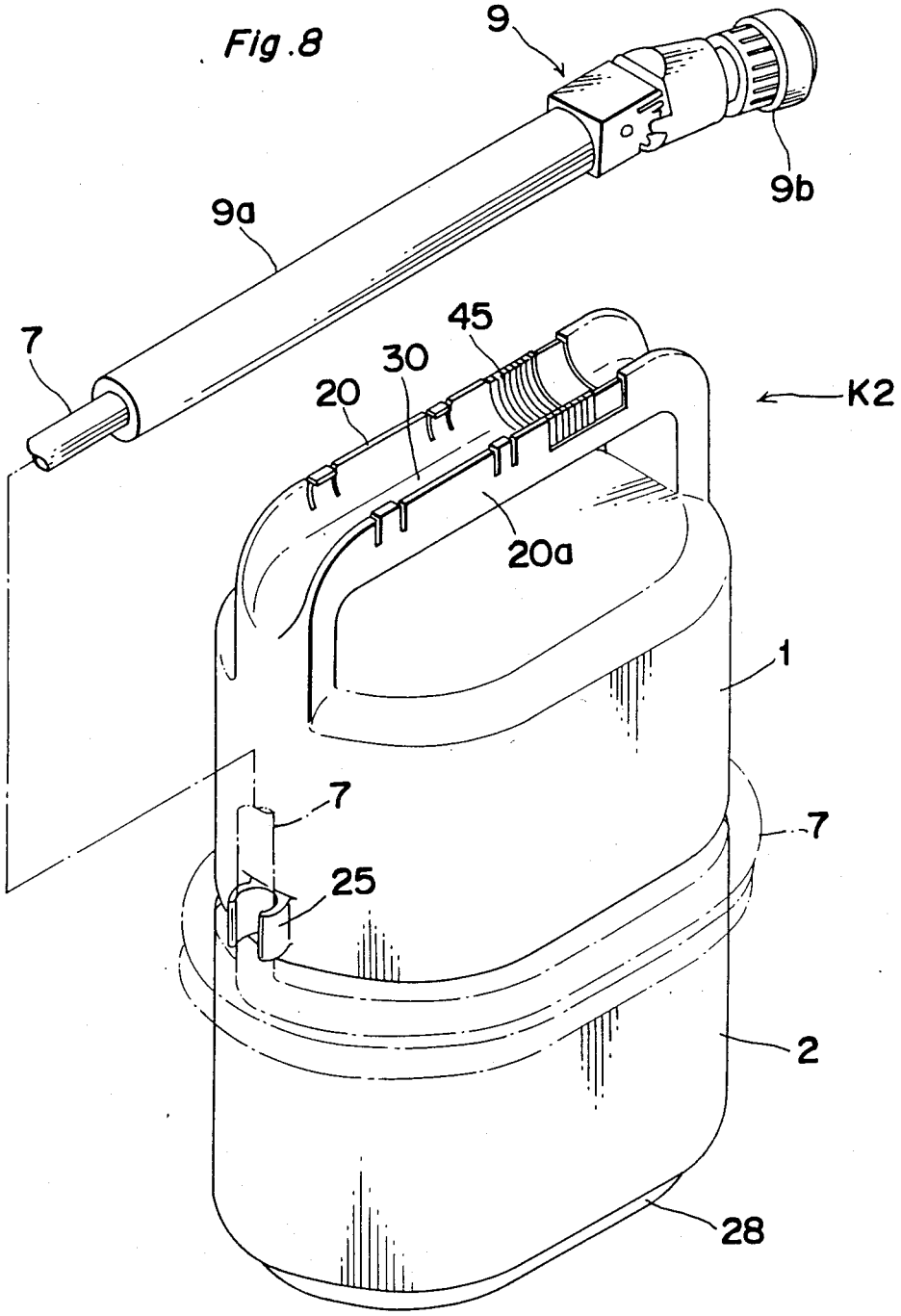
FIGS. 8 and 9 are views similar to FIGS. 1 and 3, respectively, particularly showing a second embodiment of the present invention.

Referring to FIGS. 6 and 7, there is shown an electric spray K1' which is a modification of the electric spray K1. In the modified electric spray K1', a circular battery opening 35 having a diameter slightly larger than that of the batteries 12 is formed on the bottom wall 3. The spray K1' includes a support frame 36 for supporting the batteries 12, an upper frame 37 for depressing the batteries 12, two contact plates 38 and two contact plates 39. The support frame 36 is made of a leaf spring and is extended from the inner face of the side wall of the spray casing 1 towards the battery opening 35. The contact plates 38 are attached to the lower face of the upper frame 37, while the contact plates 39 are attached to the upper face of the bottom wall 3 such that each of the batteries 12 is interposed between each of the contact plates 38 and each of the contact plates 39. In the casing K1', after the tank 2 has been detached from the spray casing 1, the batteries 12 are each inserted into the spray casing 1 through the battery opening 35 and then, are slid towards the support frame 36 so as to be retained by the support frame 36. The spray K1' is not provided with a battery cover for covering the battery opening 35. However, since the battery opening 35 is formed on the bottom wall 3 confronting the tank 2, there is no possibility that the water or the chemical liquid penetrates into the spray casing 1 from the battery opening 35 during the spreading operations. Thus, in the spray K1', it becomes unnecessary to provide the battery cover for closing the battery opening 35. Accordingly, in the spray K1', the spray casing 1 has been simplified in structure and interchange of the batteries 12 can be performed easily and quickly.

As is clear from the foregoing description, in the spray K1, since the battery opening 10 is formed on the bottom wall 3 of the spray casing 1 and the bottom wall 3 confronts the tank 2, there is no possibility that the water or the chemical liquid penetrates into the spray casing 1 even if the water or the chemical liquid splashes on the spray casing 1 during the spreading operations. Furthermore, such an inconvenience associated with the prior art sprays can be obviated that the battery cover is damaged through its contact with branches of the trees or other articles. Moreover, the batter cover 11 is not required to be of watertight construction. Meanwhile, in the spray K1', since the battery cover is not required to be provided, the spray casing 1 can be simplified in structure.

Figure 9:
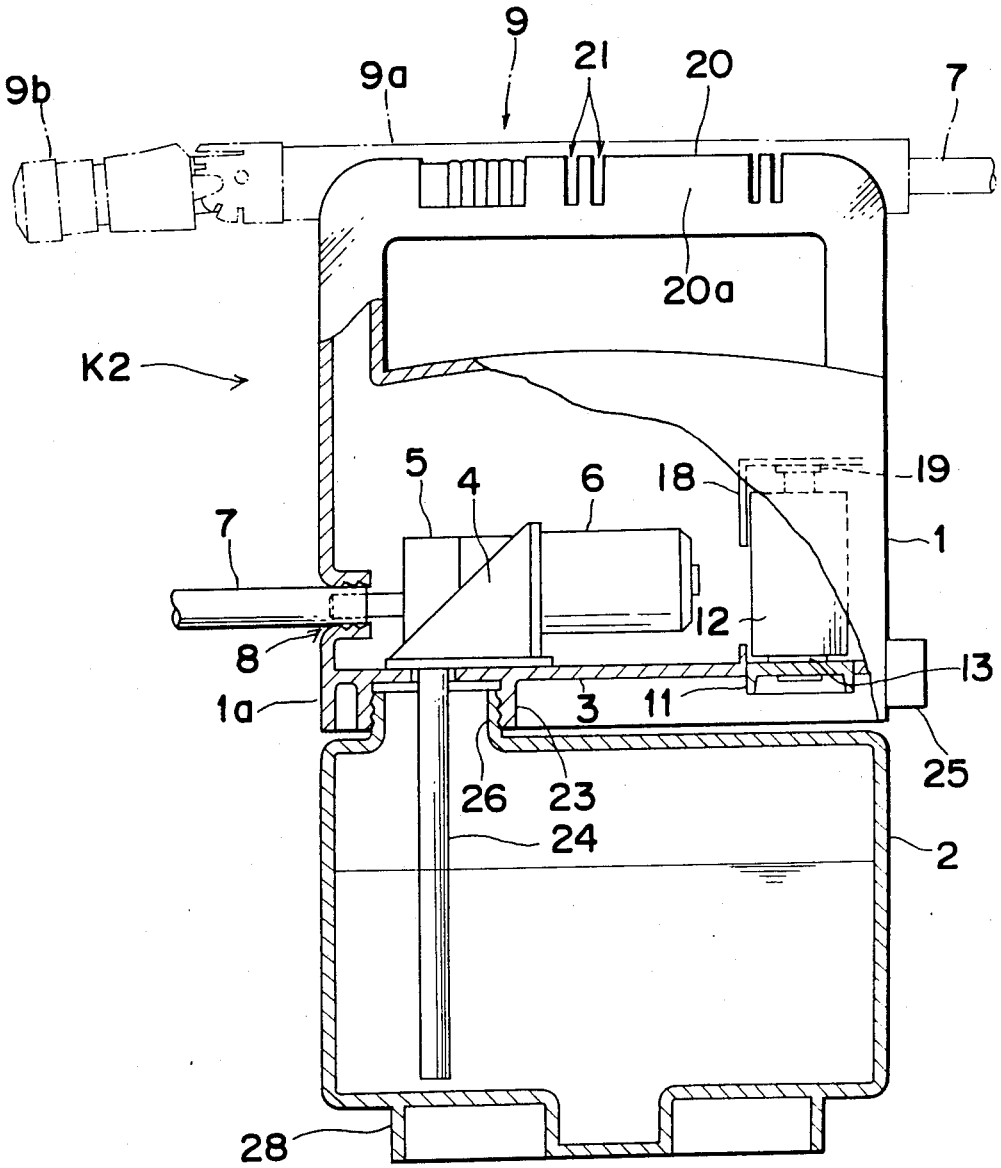
Figure 10:
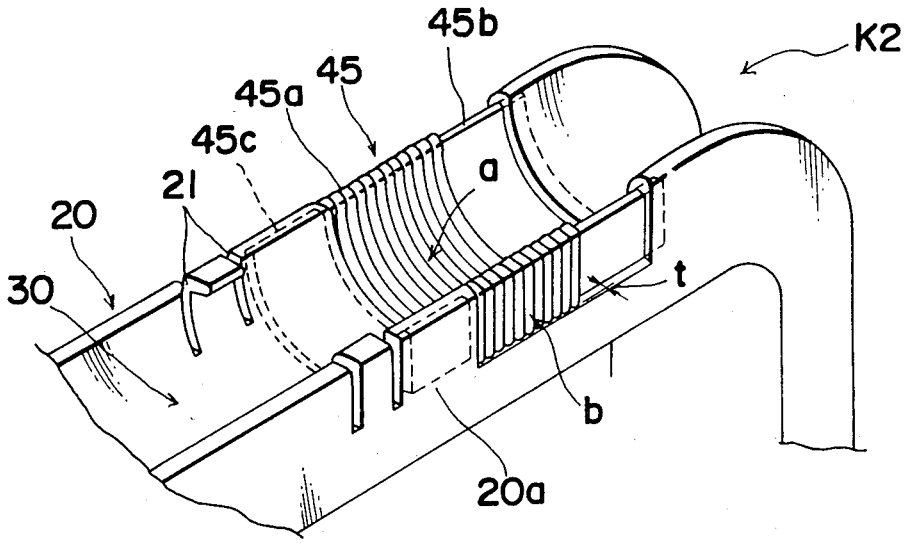
FIG. 10 is a perspective view of a slide switch button employed in the electric spray of FIG. 8.
Figure 11:
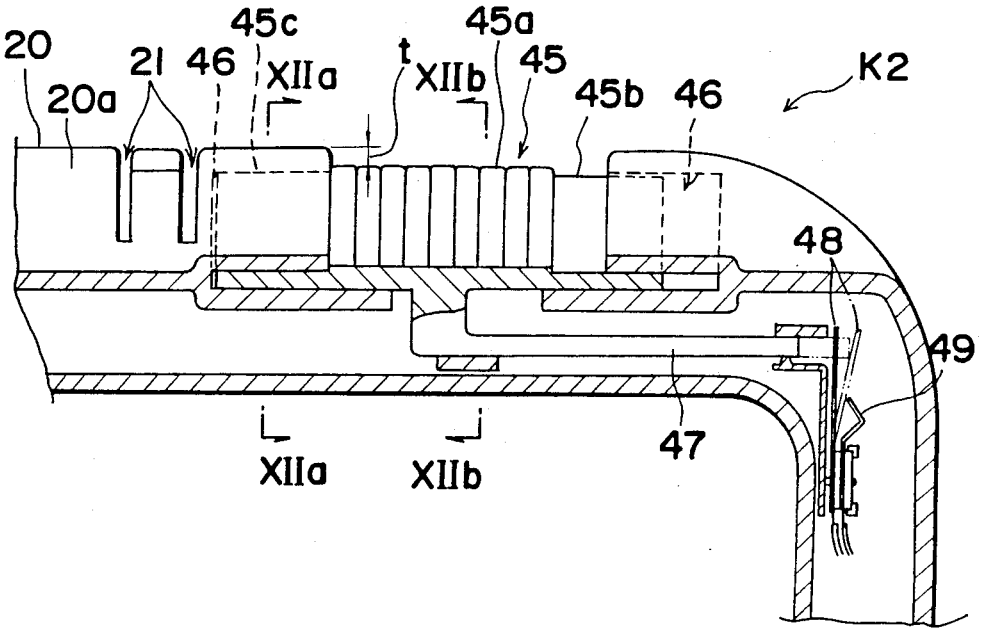
FIG. 11 is a longitudinal sectional view of the slide switch button of FIG. 10.
Figure 12A:
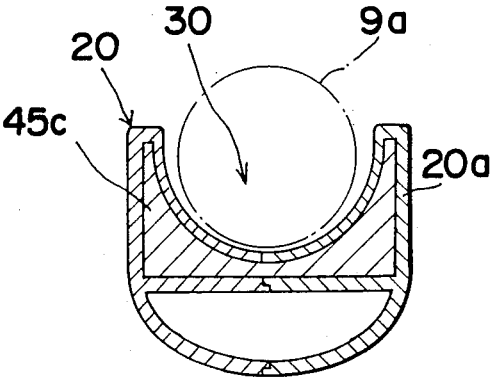
FIGS. 12*a* and 12*b* are cross-sectional views taken along the lines XIIa—XIIa and XIIb—XIIb in FIG. 11, respectively.
Figure 12B:
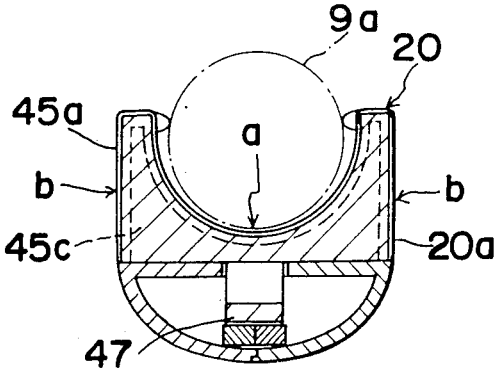

Referring to FIGS. 8 to 12, there is shown an electric spray K2 according to a second embodiment of the present invention. The electric spray K2 includes the grip 20 of double wall construction having a U-shaped cross-section and a slide switch button 45. In order to impart slight elasticity to the grip 20, the grip 20 is formed, at its opposite side walls 20*a*, with a plurality of the slits 21 in the same manner as in the spray K1. Although the nozzle unit 9 is retained by the grip 20 by elastically and detachably fitting the grip portion 9*a* into the recess 30, it can be also so arranged that the tube 7 is detachably fitted into the recess 30. The slide switch button 45 is provided at an upper front portion of the grip 20 and has a substantially M-shaped cross section. The slide switch button 45 includes a central portion 45*a*, a front portion 45*b* and a rear portion 45*c*. The front portion 45*b* and the rear portion 45*c* are, respectively, slidably fitted into hollow portions 46 of the grip 20 of double wall construction. The central portion 45*a* is formed slightly larger, in size, than the front portion 45*b* and the rear portion 45*c*. The central portion 45*a* is formed, on its outer peripheral face, with indentations for nonslip purpose. Furthermore, a gap t is defined between the outer peripheral face of the slide switch button 45 and that of the grip 20 in the sidewise and longitudinal directions of the grip 20 as shown in FIGS. 10 and 11. Thus, such undesirable phenomena can be prevented that the slide switch button 45 is damaged or is inadvertently turned on due to its contact with an article or the nozzle unit 9 engaged with the grip 20.

As shown in FIG. 11, the slide switch button 45 includes an elongated push bar 47 extending forwardly from the lower face of the slide switch button 45. A movable contact piece 48 and a fixed contact piece 49 are provided forwardly of the push bar 45. When the slide switch button 45 is slid forwardly, the movable contact piece 48 is depressed forwardly by the push bar 47 so as to be brought into contact with the fixed contact piece 49, so that a drive circuit of the motor is closed and thus, operation of the pump 5 is started. Therefore, the water on the chemical liquid in the tank 2 is sucked up by the pump 5 so as to be fed to the nozzle unit 9 and then, is injected from the nozzle portion 9*b*. As shown in FIG. 9, the suction hose 24 is deviated towards the tube outlet 8 from the central axis of the tank 2.

Referring back to FIG. 10, an upper face a and opposite side faces b of the slide switch button 45 of the above described arrangement, except for its lower face, are exposed outwardly from the grip 20 so as to extend from the upper face of the grip 20 to the opposite side walls 20*a* abutting on the upper face of the grip 20, with the upper face of the grip 20 defining the recess 30. In the case where the nozzle unit 9 has been detached from the grip 20, the slide switch button 45 can be slidably operated easily by depressing the upper face a of the slide switch button 45 with a finger tip of one hand holding the grip 20. Meanwhile, in the case where the nozzle unit 9 has been mounted on the grip 20, the upper face a of the slide switch button 45 is shielded by the nozzle unit 9. However, at this time, the opposite side faces b of the slide switch button 45 are exposed outwardly. Accordingly, the slide switch button 45 can be slidably operated easily by depressing one of the opposite side faces b with a finger tip of one hand holding the grip 20. This, the slide switch button 45 extends from the upper face of the grip 20 and the opposite side walls 20*a*. Therefore, it is possible to spread the water or the chemical liquid over trees or flowers upon sliding operation of the slide switch button 45 by depressing the upper face a of the slide switch button 45 with a finger tip of one hand holding the grip 20 while the nozzle unit 9 detached from the grip 20 is being grasped by the other hand. Meanwhile, even in the case where the nozzle unit 9 has been mounted on the grip 20 such that the nozzle portion 9*b* is directed towards the slide switch button 45, it is possible to perform the spreading operations upon sliding operation of the slide switch button 45 by depressing one of the opposite side faces b of the slide switch button 45 with a finger tip of one hand holding the grip 20.

It is to be noted that the spray K2 can be modified variously. For example, although the opposite side faces b are exposed outwardly from the grip 20, it can be also so arranged that only one of the opposite side faces b is exposed outwardly from the grip 20.

Figure 13A:
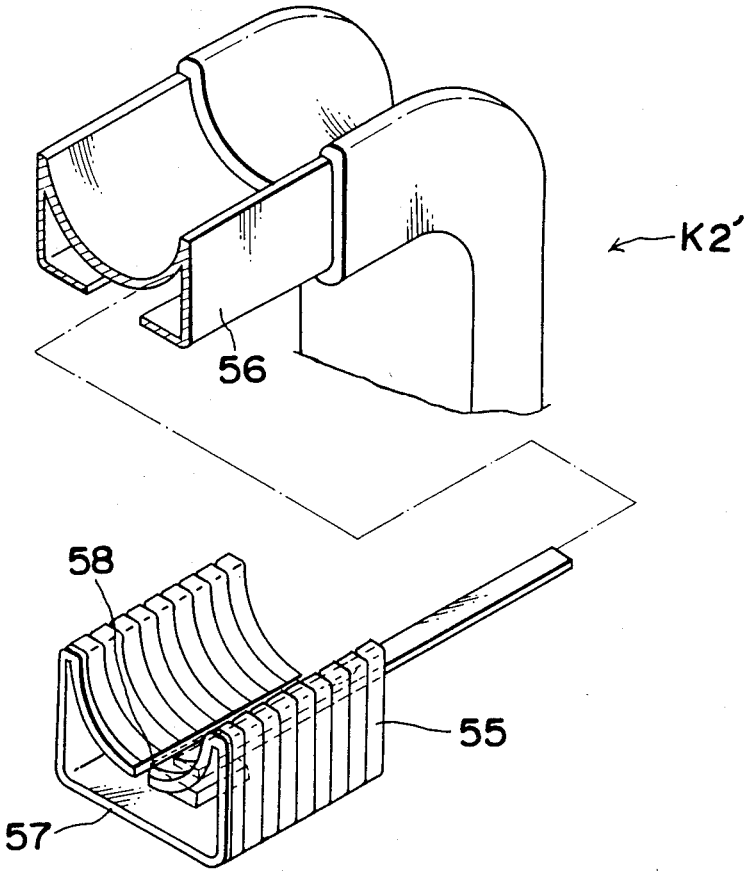
FIG. 13*a* is an exploded perspective view of a slide switch button which is a first modification of the slide switch button of FIG. 10.
Figure 13B:
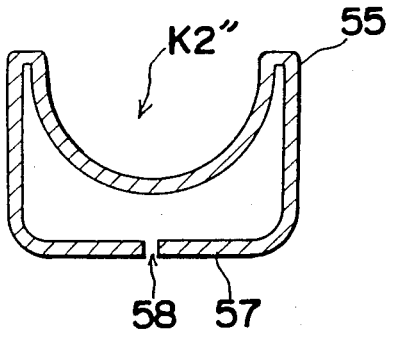
FIGS. 13*b* and 13*c* are cross-sectional views of slide switch buttons which are second and third modifications of the slide switch button of FIG. 10, respectively.
Figure 13C:
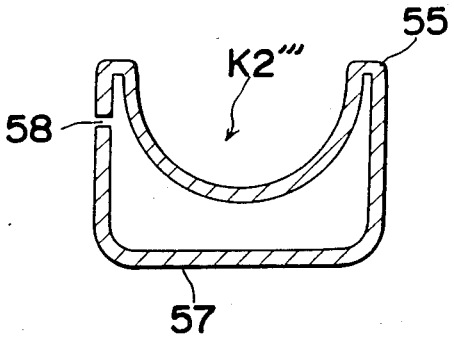

Referring to FIGS. 13*a*, 13*b* and 13*c*, there are shown electric sprays K2′, K2″ and K2‴ which are first, second and third modifications of the electric spray K2, respectively. The spray K2′ includes a tubular slide switch button 55. The slide switch button 55 can be formed with a longitudinally extending slit 56. In the case where the slide switch button 55 is made of elastic synthetic resin or rubber, the slide switch button 55 can be fitted around an overall periphery of a grip 56 by expanding the slit 58 through utilization of elasticity of the slide switch button 55. Since the grip 56 is of such a complicated cross section as to be formed with the recess for receiving the nozzle unit 9, the slide switch button 55 is securely fitted around the grip 56 and thus, it is unnecessary to additionally provide a member for increasing a coupling force for coupling the slide switch button 55 with a grip 56. Furthermore, the slide switch button 55 can be easily assembled with the grip 56. Moreover, since the slide switch button 55 is slidably fitted, also at the bottom wall 57, around the overall periphery of the grip 56, operability of the slide switch button 55 is improved. In the spray K2′, the slit 58 is formed on the top wall. On the other hand, in the spray K2″, the slit 58 is formed on the bottom wall 57, while in the spray K2‴, the slit 58 is formed on one of the opposite side walls.

As is clear from the foregoing description, in the spray K2, the slide switch button 45 extends from the upper face of the grip 20 to the opposite side walls 20*a* abutting on the upper face of the grip 20, with the upper face of the grip 20 defining the recess 30. Accordingly, in the case where the nozzle unit 9 has been not only mounted on but detached from the grip 20, the slide switch button 45 can be slidably operated easily by a finger tip of one hand holding the grip 20.

Figure 14:
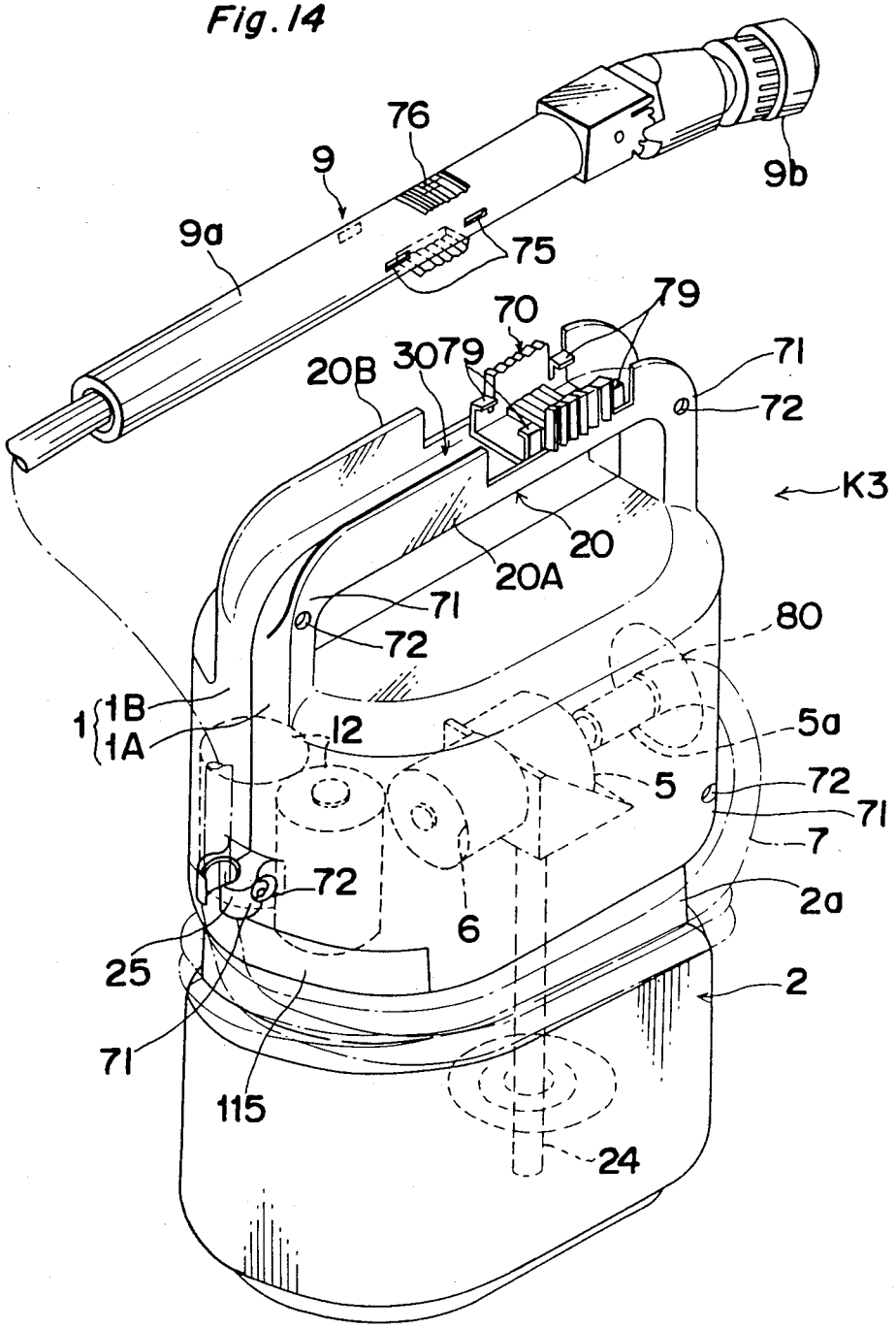
FIG. 14 is a view similar to FIG. 1, particularly showing a third embodiment of the present invention.
Figure 15:
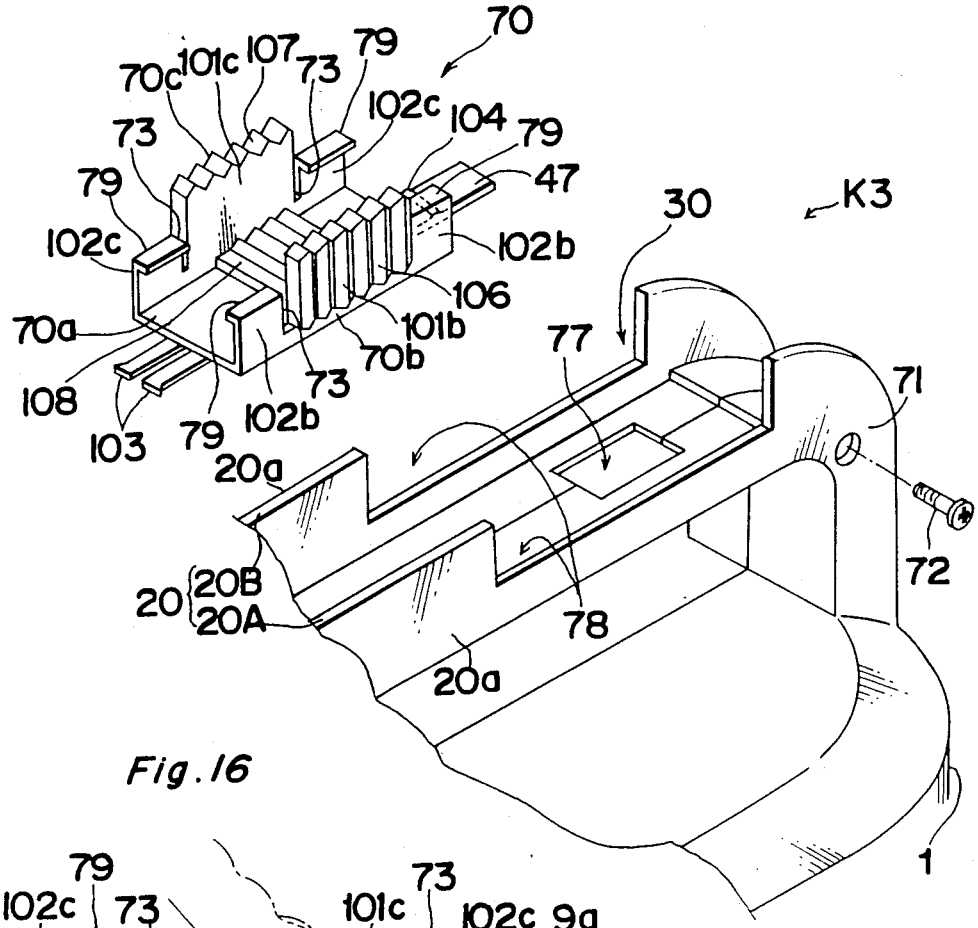
FIG. 15 is an exploded perspective view of a slide switch member employed in the electric spray of FIG. 14.
Figure 16:
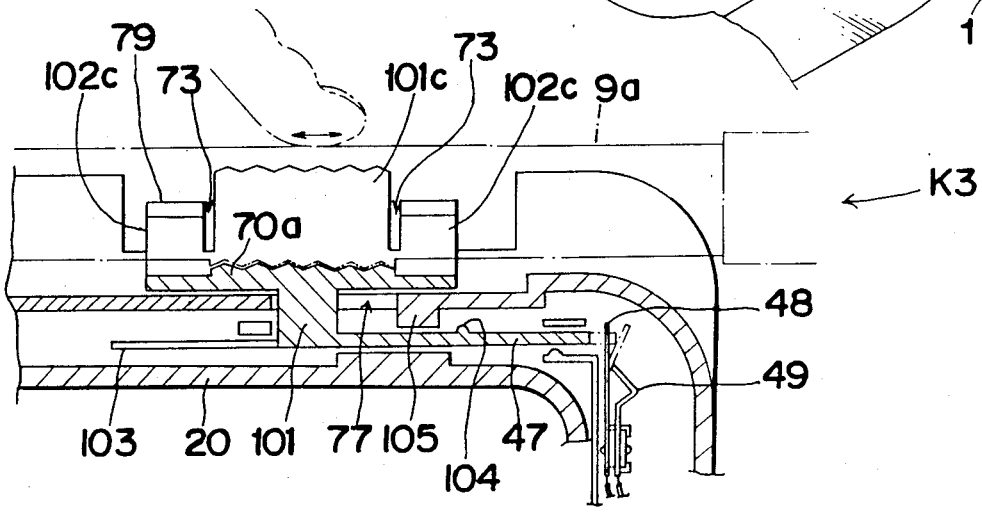
FIG. 16 is a longitudinal sectional view of the slide switch member of FIG. 15.

Referring further to FIGS. 14 to 16, there is shown an electric spray K3 according to a third embodiment of the present invention. In the spray K3, the spray casing 1 and the tank 2 are of elliptic cross section. The tank 2 is formed, at an upper portion thereof, with a recessed portion 2*a* for receiving the tube 7 such that the tube 7 is wound around the recessed portion 2*a*. The spray casing 1 is constituted by a pair of split half portions 1A and 1B split along a line which longitudinally divides the grip 20 equally. Thus, the grip 20 is formed by a pair of split halves 20A and 20B. The split half portions 1A and 1B are formed separately from each other and then, are coupled with each other at four bosses 71 by screws 72. The bosses 71 are disposed away from a central portion of the spray casing 1.

The spray K3 includes a switch member 70. Meanwhile, the grip portion 9*a* is formed, on its peripheral face, with four longitudinally extending slots 75. As shown in FIG. 15, the switch member 70 has a substantially U-shaped cross section and is constituted by a bottom portion 70*a* and opposite side wall portions 70*b* and 70*c*. As shown in FIG. 16, a projection 101 is formed on the lower face of the bottom portion 70*a*. The push bar 47 is extended forwardly from the projection 101, while a pair of detent bars 103 are extended rearwardly from the projection 101. The push bar 47 and the detent bars 103 are accommodated in the bottom portion of the grip 20 of double wall construction. Thus, the switch member 70 is slidably mounted on the grip 20 so as to be slid in the longitudinal direction of the grip 20. A protuberance 104 is formed on the upper face of the push bar 47 in the sidewise direction of the push bar 47 so as to prevent the water or the chemical liquid penetrating into the spray casing 1 through a clearance between the split halves 20A and 20B from proceeding towards the contact portion of the push bar 47. Furthermore, when the switch member 70 is slid on the grip 20, the protuberance 104 is brought into contact with a protrusion 105 formed on the lower face of the upper wall of the bottom portion of the grip 20 so as to be wiped by the protrusion 105 such that the water or the chemical liquid present on the push bar 47 is forcibly drawn downwardly.

Meanwhile, a rectangular elongated opening 77 is formed on a front portion of the upper wall of the grip 20 in the longitudinal direction of the grip 20 such that the projection 101 is retractably inserted into the elongated opening 77. The opposite side walls 20*a* are formed with rectangular cut-outs 78, respectively such that the elongated opening 77 is interposed between the cutouts 78. When the switch member 70 has been mounted on the grip 20, the opposite side wall portions 70*b* and 70*c* confront the cut-outs 78, respectively. The movable contact piece 48 and the fixed contact piece 49 are provided forwardly of the push bar 47 in the grip 20. When the switch member 70 is slid forwardly, the movable contact piece 48 is brought into contact with the fixed contact piece 49. Thus, since the drive circuit of the motor 6 is closed so as to actuate the pump 5, the water or the chemical liquid in the tank 2 is fed to the nozzle unit 9 and then, is spouted from the nozzle portion 9*b*.

The side wall portion 70*b* includes a central portion 101*b* and opposite end portions 102*b*. Slits 73 are, respectively, formed between the central portion 101*b* and one end portion 102*b* and between the central portion 101*b* and the other end portion 102*b*. Similarly, the side wall portion 70*c* includes a central portion 101*c* and opposite end portions 102*c*. The slits 73 are, respectively, formed between the central portion 101*c* and one end portion 102*c* and between the central portion 101*c* and the other end portion 102*c*. Each of the central portions 101*b* and 101*c* is formed, on an outer side face and an upper face thereof, with nonslip portions 106 and 107, respectively. Furthermore, a nonslip portion 108 is formed on the upper face of the bottom portion 70*a*. When the nozzle unit 9 has been detached from the grip 20, these nonslip portions 106, 107 and 108 are used for sliding the switch member 70. Each of the central portions 101*b* and 101*c* is formed slightly lower and thinner than each of the opposite end portions 102*b* and 102*c*. The central portions 101*b* and 101*c* are slidably fitted in the cutouts 78, respectively. Meanwhile, the opposite end portions 102*b* and 102*c* are slidably fitted inside the opposite side walls 20*a* of the grip 20. Slight elasticity is imparted to the opposite end portions 102*b* and 102*c* by the slits 73. Moreover, each of the end portions 102*b* and 102*c* is formed, at an upper face thereof, with a sidewise inwardly extending lip 79 and that the lips 79 of the end portions 102*b* confront the lips 79 of the end portions 102*c*, respectively.

Figure 17:
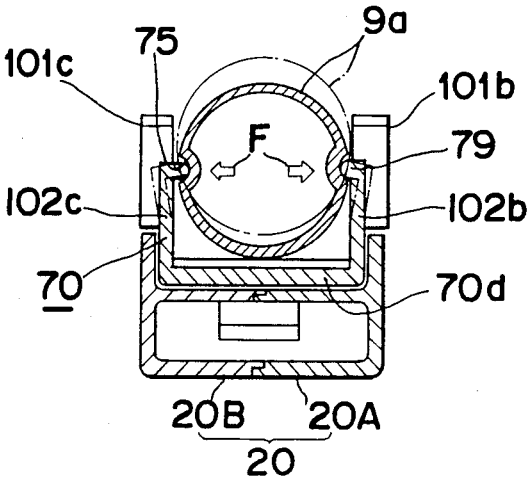
FIG. 17 is a cross-sectional view of the slide switch member of FIG. 14.
Figure 18:
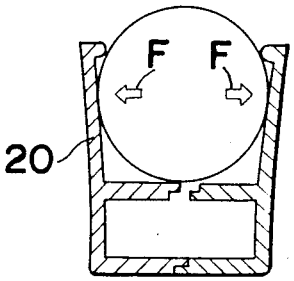
FIG. 18 is a view explanatory of action of the slide switch member of FIG. 14.

When the grip portion 9*a* has been mounted on the switch member 70, the lips 79 of the switch member 70 are elastically and detachably fitted into the slots 75 of the grip portion 9*a*, respectively as shown in FIG. 17. Thus, the nozzle unit 9 is not retained by the grip 20 but is retained by the switch member 70. Accordingly, when the nozzle unit 9 has been mounted on the switch member 70, sidewise forces F are applied to the switch member 70 but are not applied to the grip 20. Consequently, such an undesirable phenomenon does not take place that the grip 20 is separated sidewise into the split halves 20A and 20B such that a gap is defined between the split halves 20A and 20B as shown in FIG. 18. Since the nozzle unit 9 is coupled with the switch member 70 through engagement of the lips 79 with the slots 75, the nozzle unit 9 and the switch member 70 are slidably moved in one unit in the operating direction of the switch member 70. Therefore, the switch member 70 can be operated by sliding the nozzle unit 9 in the operating direction of the switch member 70 with a finger tip of one hand holding the grip 20. Thus, it is advantageously possible to perform the spreading operations of the water or the chemical liquid by turning the switch member on and off with only one hand holding the grip 20. In order to slide the nozzle unit 9 together with the switch member 70, a nonslip portion 76 is formed on the outer periphery of the grip portion 9*a*.

Figure 19:
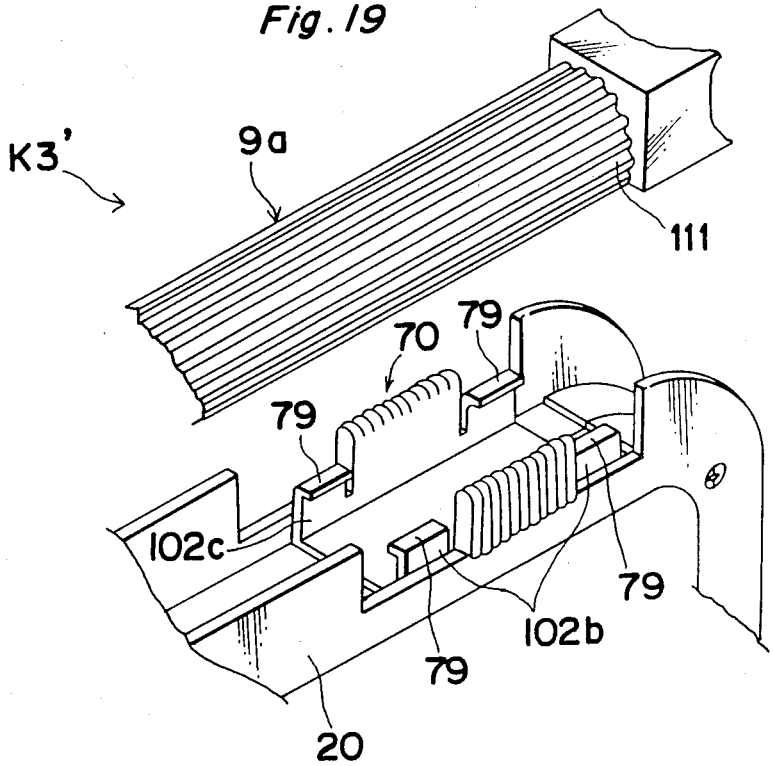
FIG. 19 is a view similar to FIG. 14, particularly showing a modification thereof.

A coupling means for coupling the grip portion 9*a* with the grip 20 is not restricted to the slots 75 and the lips 79. For example, in a modified electric spray K3′ of FIG. 19, a plurality of axially extending notches 111 are circumferentially formed on the outer periphery of the grip portion 9*a* such that the lips 79 are brought into engagement with the notches 111. In this spray K3′, the grip portion 9*a* is not moved together with the switch member 70. However, since the grip portion 9*a* can be positioned at an arbitrary circumferential location thereof by the notches 111, the grip portion 9*a* can be accommodated in the switch member 70 efficiently. Furthermore, by changing the circumferential mounting position of the grip portion 9*a* relative to the switch member 70, it is possible to variously change directions of injection of the water or the chemical liquid from the nozzle portion 9*b*.

Furthermore, a tubular member 80 for drawing the tube 7 out of the spray casing 1 is provided at the tube outlet 8 (FIG. 4) and will be described with reference to FIGS. 20 to 23, hereinbelow. The tubular member 80 is formed by coupling a pair of split half portions 80A and 80b with each other. Each of the half portions 80A and 80B includes a half tube 81 and a half flange 82 extending from the half tube 81. A pair of ribs 83 are provided at opposite sides of the half tube 81. A pin 84 and an aperture 85 are formed on each of the ribs 83 such that the pins 84 of the half portion 80B are fitted into the apertures 85 of the half portion 80A, while the pins 84 of the half portion 80A are fitted into the apertures 85 of the half portion 80B, whereby the half portions 80A and 80B are securely coupled with each other. The tube 7 is embraced, at one end portion thereof, by the tubular member 80. In order to prevent the tube 7 from being detached from the tubular member 80, a plurality of circumferentially extending indentations 86 are formed on the inner periphery of the half tube 81. A pair of vertically extending plates 87 are provided at opposite sides of the half tube 81 and are slightly elastic. Furthermore, a saw-toothed engageable portion 88 is formed on the outer side face of each of the plates 87. A positioning piece 89 is formed on the half tube 81 so as to extend in the axial direction of the half tube 81. A pair of lugs 90 are formed, at opposite sides of the half flange 82, on one of opposite faces of the half flange 82 adjacent to the half tube 81. An opening 91 is formed at a coupling portion of the split half portions 1A and 1B. A pair of grooves 92 for receiving the lugs 90, respectively are formed at opposite sides of the opening 91. Four triangular projections 93 are provided in the opening 91 such that a pair of sidewise opposite slits 94 are defined between one pair of the projections 93 and between the other pair of the projections 93.

Figure 20:
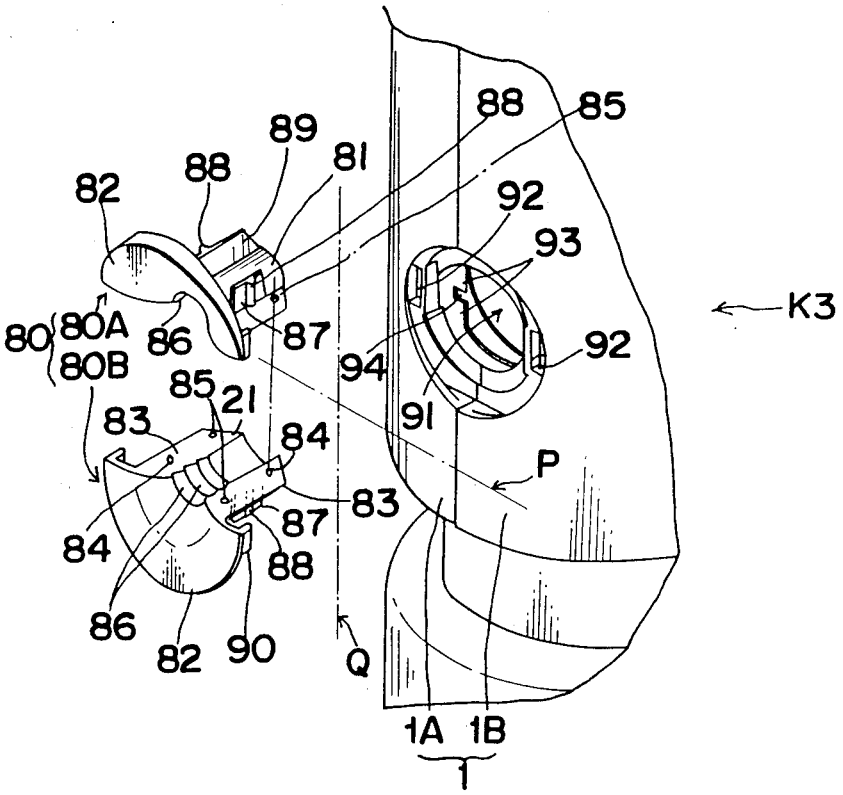
FIG. 20 is an exploded perspective view of a tubular member employed in the electric spray of FIG. 14.
Figure 21:
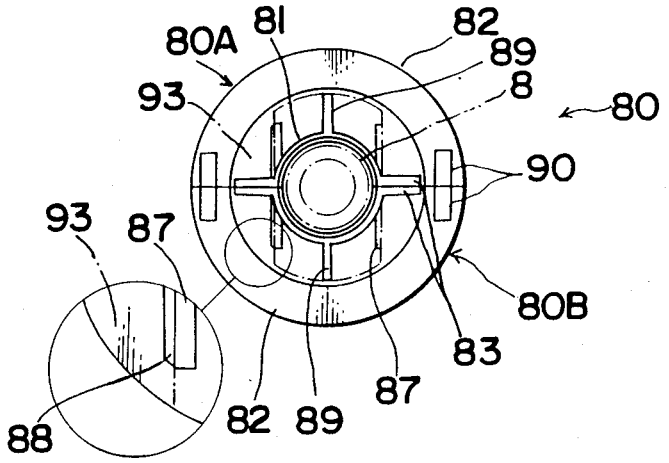
FIG. 21 is a front elevational view of the tubular member of FIG. 20.
Figure 22A:
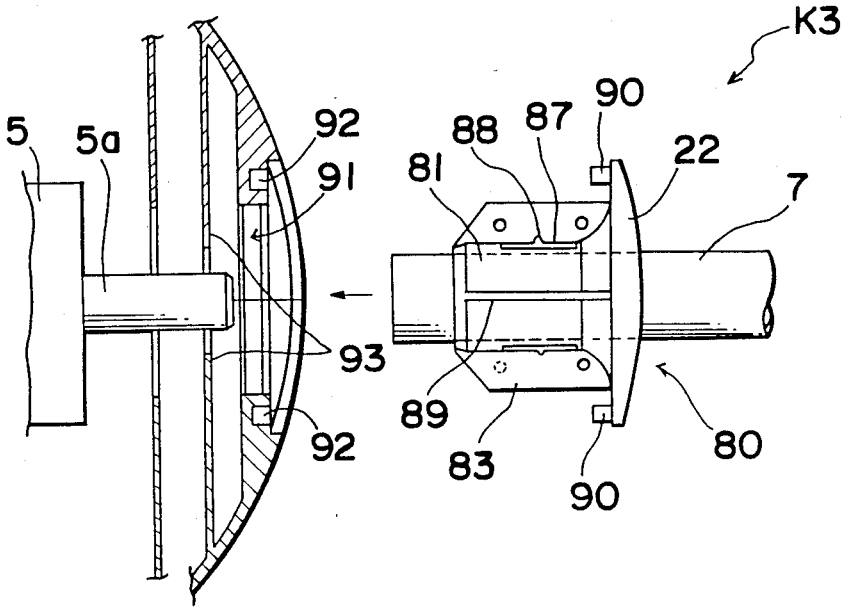
FIGS. 22*a* and 22*b* are views explanatory of mounting of the tubular member of FIG. 20.
Figure 22B:
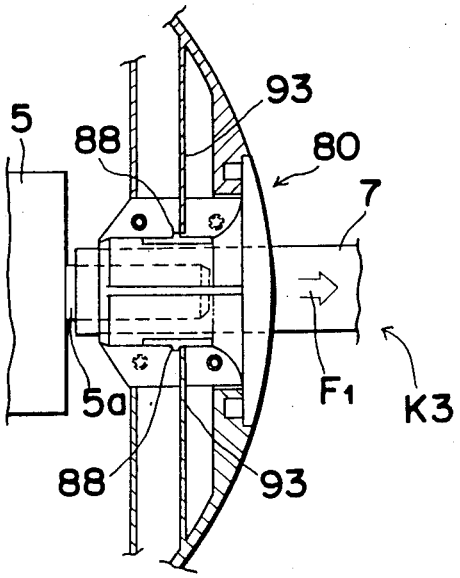
Figure 23:
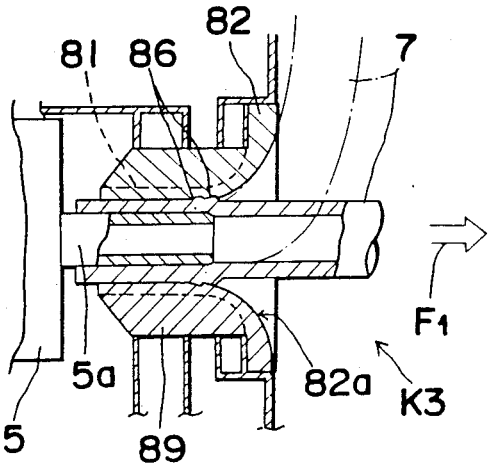
FIG. 23 is a view explanatory of action of the tubular member of FIG. 20.

In the case where the tube 7 is connected with a discharge portion 5*a* of the pump 5, the end portion of the tube 7 is initially retained by the tubular member 80 in which the split half portions 80A and 80B are coupled with each other in the horizontal direction, i.e., in the direction perpendicular to the vertical coupling direction of the split half portions 1A and 1B of the spray casing 1 as shown in FIG. 22*a*. Thereafter, the tubular member 80 is held by one hand of the operator and then, is inserted into the opening 91. Namely, as shown in FIG. 20, the coupling line P of the tubular member 80 is oriented at right angles to the coupling line Q of the spray casing 1. Thus, the split half portions 1A and 1B of the spray casing 1 are coupled with each other not only by the screws 72 but through engagement of the lugs 90 with the grooves 92. The discharge portion 5*a* of the pump 5 confronts the opening 91. The tube 7 is forcibly fitted around the discharge portion 5*a* such that the engageable portions 88 are retained by the projections 93 as shown in FIG. 22*b*. The ribs 83 and the positioning pieces 89 act not only as a guide member for inserting the tubular member 80 into the opening 91 but as a positioning member for fixedly securing the tubular member 80 in the opening 91. Especially, since each of the ribs 83 is fitted into each of the slits 94 so as to be retained between the projections 93, the split half portions 80A and 80B of the tubular member 80 are coupled with each other more securely, as shown in FIG. 21. Thus, at the time when the tube 7 is fitted around the discharge portion 5*a* of the pump 5, the engageable portions 88 are elastically retained by the projections 93 through contraction of the wall thickness of the tube 7 made of flexible material and elasticity of the plates 87. When the tube 7 has been fitted around the discharge portion 5*a*, a radially outward force is applied to the tubular member 80 by an elastic restoring force of the tube 7 and thus, the engageable portions 88 are positively secured by the projections 93. At this time, the indentations 86 formed on the inner periphery of the half tubes 81 bite into the outer periphery of the tube 7 as shown in FIG. 23 and the tube 7 is elastically retained securely between the discharge portion 5*a* and the tubular member 80. Accordingly, the tube 7 is secured in position by the tubular member 80 in the direction for detaching the tube 7 from the tubular member 80. Thus, even if an axially outward force F1 is applied to the tube 7, the tube 7 is not readily detached from the discharge portion 5*a* or the tubular member 80 does not vibrate due to effects of a fitting force between the tube 7 and the discharge portion 5*a* and positioning of the tube 7 by the tubular member 80. Furthermore, since the tubular member 80 is formed, at its outer end, with the half flanges 82 extending radially outwardly, the tube 7 can be flexibly bent along tapered faces 82*a* of the half flanges 82, as shown by one-dot chain lines in FIG. 23. Namely, the tubular member 80 acts also as a guide member for flexibly drawing the tube 7 out of the spray casing 1. Meanwhile, as best shown in FIG. 20, since the lugs 90 of the tubular member 80 are fitted into the grooves 92 formed on the split half portions 1A and 1B of the spray casing 1, respectively, the split half portions 1A and 1B of the spray casing 1 are coupled with each other more securely.

Figure 24:
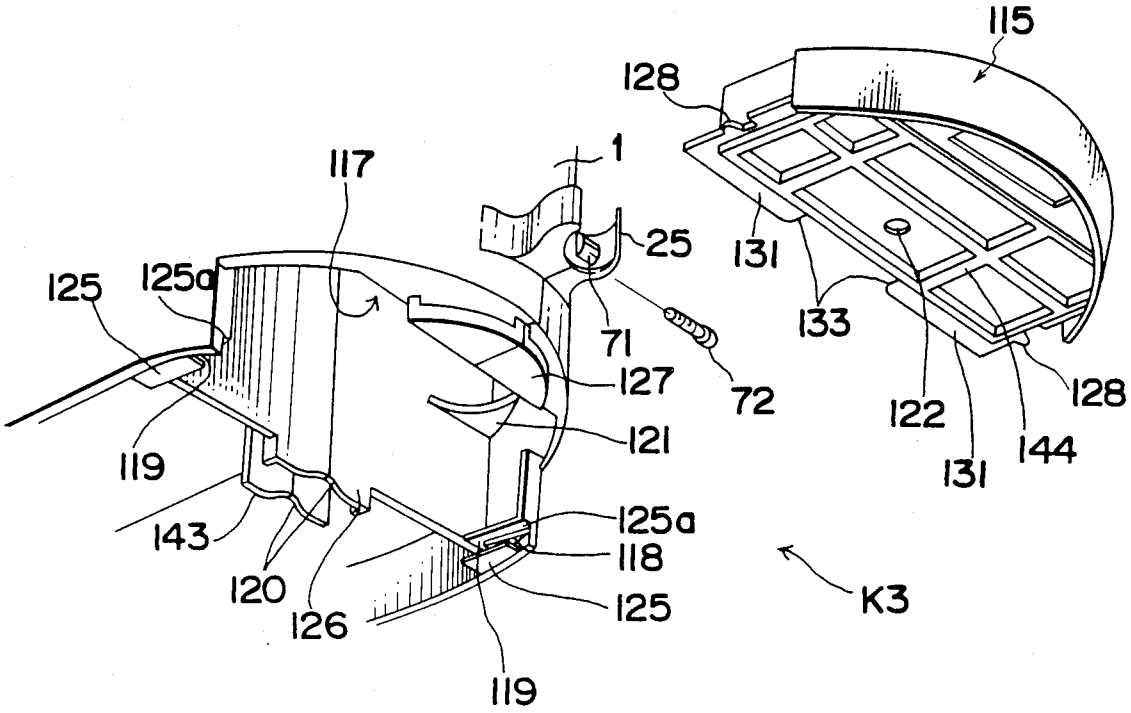
FIG. 24 is an exploded perspective view of a battery cover employed in the electric spray of FIG. 14.

Moreover, a battery cover 115 is slidably mounted on the bottom portion of the spray casing 1 so as to confront the tank 2 and will be described with reference to FIGS. 24 to 26, hereinbelow. An opening 117 for accommodating the batteries 12 is formed at the bottom portion of the spray casing 1. A positioning piece 121 for securing the batteries 12 in position is provided in the opening 117. The tube hook 25 is provided with the boss 71 and is integrally formed with the spray casing 1 such that the split half portions 1A and 1B of the spray casing 1 are coupled with each other at the boss 71 by the screw 72. A first cover support 126 and a second cover support 127 are integrally formed, at the periphery of the opening 117, with the spray casing 1 and each of the first and second cover supports 126 and 127 is split into two half portions in the same manner as the spray casing 1. The coupling pipe 23 of the spray casing 1 is slightly deviated from the central portion of the spray casing 1. When the tank 2 is rotated through 90° from its coupling position relative to the spray casing 1, as shown by one-dot chain lines in FIG. 26, the battery cover 115 is exposed outwardly. The battery cover 115 is formed with a drainage hole 122, while the spray casing 1 is formed with drainage holes 141 and 142. These drainage holes 122, 141 and 142 are designed to drain out of the spray casing 1 the water or the chemical liquid having penetrated into the spray casing 1. Meanwhile, as shown in FIG. 25*b*, a protrusion 130 is formed on the tank 2. When the tank 2 is coupled with the spray casing 1, the protrusion 130 is brought into contact with recessed portions 120 which are, respectively, formed at the substantially central portions of the first cover support 126 and a vertical wall 143 extending in a side by side relationship with respect to the first cover support 126. Thus, it becomes possible to ensure upon contact of the protrusion 130 with the recessed portions 120 that the tank 2 has been normally mounted on the spray casing 1.

Figure 25A:
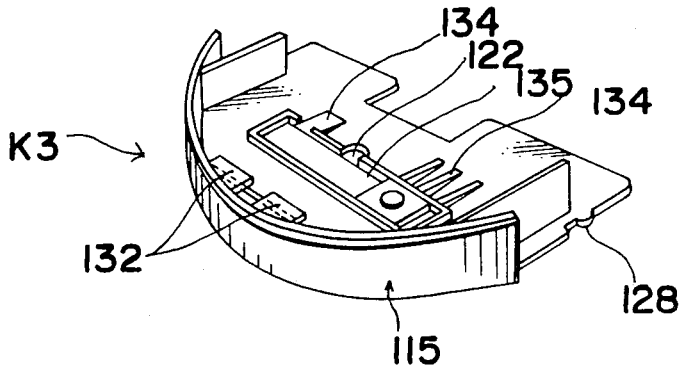
FIG. 25*a* is a perspective view of the battery cover of FIG. 24.
Figure 25B:
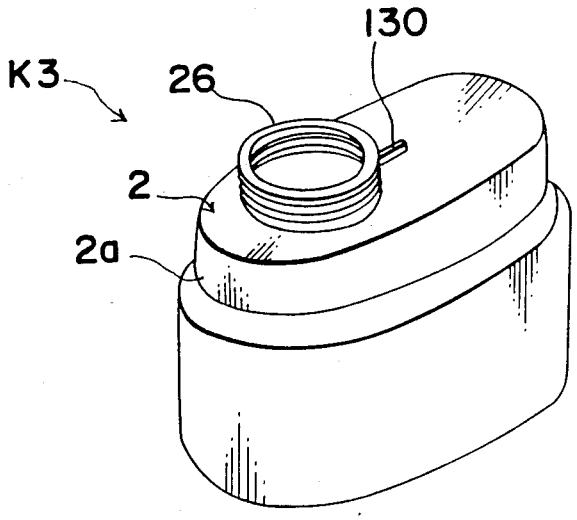
FIG. 25*b* is a perspective view of a tank employed in the electric spray of FIG. 14.
Figure 25A:
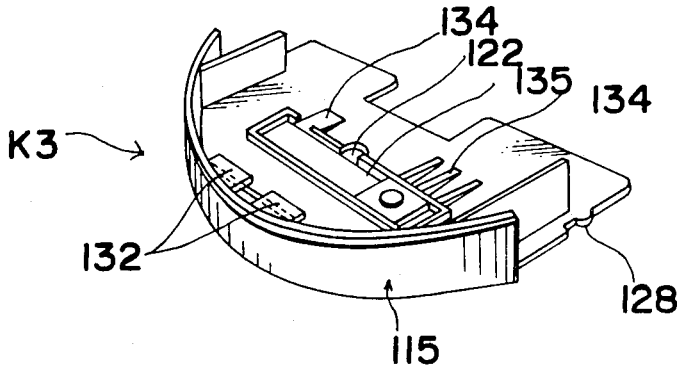
Figure 25B:
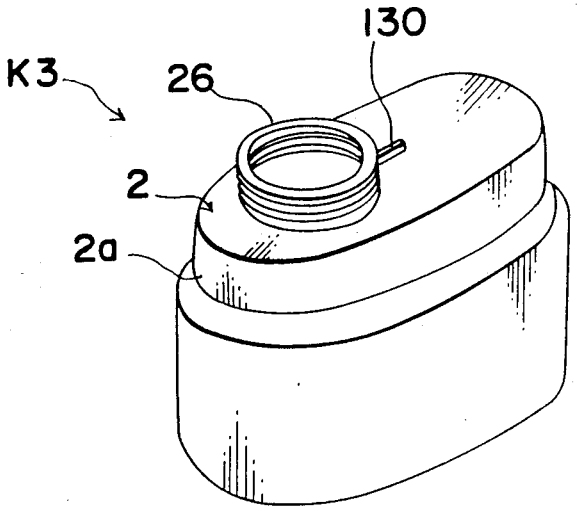
Figure 26:
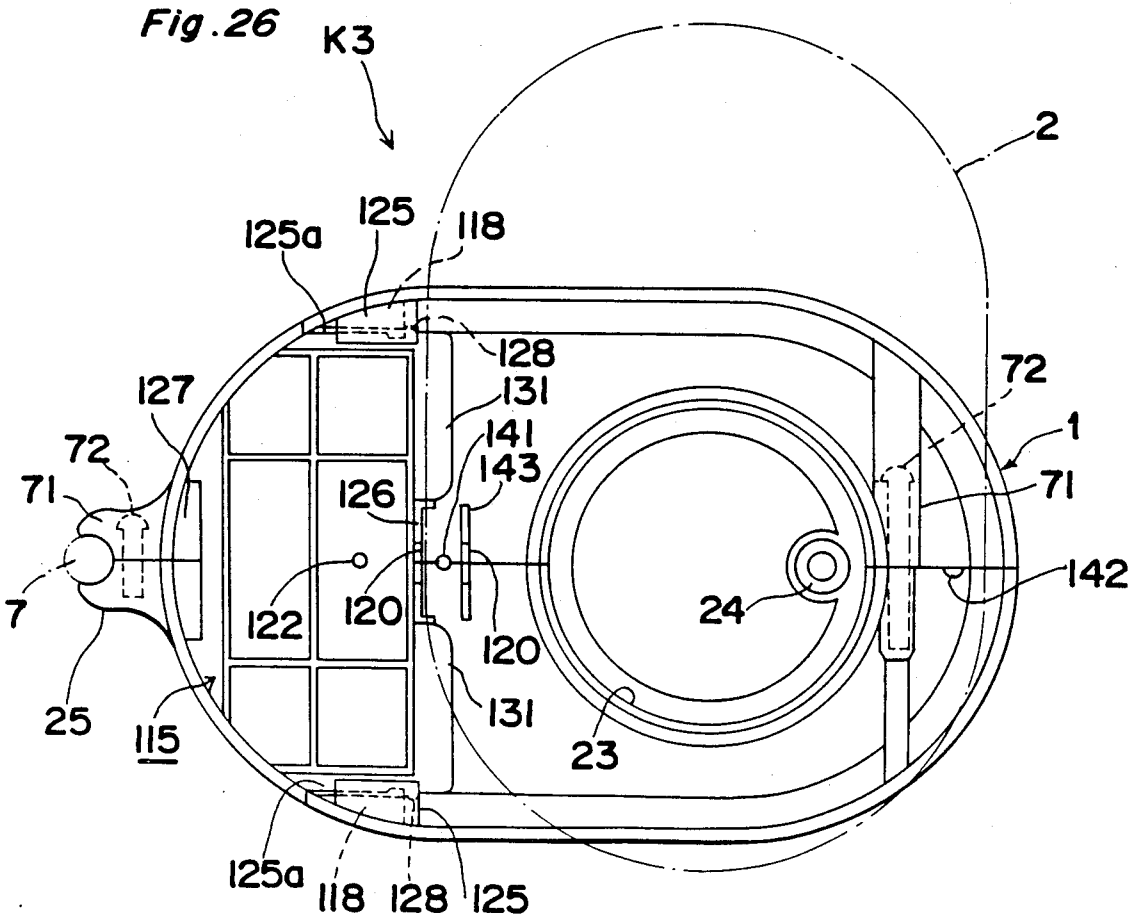
FIG. 26 is a bottom plan view of a spray casing employed in the electric spray of FIG. 14.

As shown in FIG. 25*a*, a contact plate 135 is provided on the upper face of the battery cover 115. Oblique guide portions 134 are formed at the opposite end portions of the contact plate 135 so as to extend in the direction of insertion of the batteries 12. On the other hand, a reinforcing rib 144 of a checked pattern is formed on the lower face of the battery cover 115 so as to act as a nonslip member for sliding the battery cover 115. A pair of guide grooves 119 for guiding opposite sides of the battery cover 115 are formed on the spray casing 1. A pair of projecting portion 118 are formed in the guide grooves 119, respectively so as to be brought into engagement with engageable pieces 128 provided at opposite sides of the battery cover 115. Each of the guide grooves 119 is defined by a guide plate 125. In order to facilitate mounting of the battery cover 115 on the spray casing 1, the guide plate 125 is recessed at its distal end 125*a*.

In the case where the battery cover 115 of the above described arrangement is mounted on the spray casing 1, the opposite sides of the battery cover 115 are initially slid along the guide grooves 119 into the spray casing 1. Then, when the battery cover 115 has been inserted into the spray casing 1 until the engageable pieces 128 of the battery cover 115 are brought into engagement with the projecting portions 118 as shown in FIG. 26, the batteries 12 are gradually depressed by the guide portions 134 into contact with the contact plate 135. When the battery cover 115 has been mounted on the spray casing 1, the first cover support 126 of the spray casing 1 is embraced by opposed inner side faces 133 of a pair of first tongue portions 131 of the battery cover 115 and, at the same time, a pair of second tongue portions 132 (FIG. 25*a*) of the battery cover 115 are brought into engagement with the second cover support 127, whereby the split half portions 1A and 1B of the spray casing 1 are coupled with each other more securely. As shown in FIG. 26, because of a structural difficulty in coupling the split half portions 1A and 1B with each other by the use of screws at the central portion of the spray casing 1, the bosses 72 for the screws 71 used for coupling the split half portions 1A and 1B with each other are provided at opposite sides of the spray casing 1 so as not to interfere with the pump 5 or the motor 6. However, in the spray K3, since the first cover support 126 of the spray casing 1 is embraced by the opposed inner side faces 133 of the first tongue portions 131 at the substantially central portion of the spray casing 1, the split half portions 1A and 1B are coupled with each other more positively and vibration of the split half portions 1A and 1B due to vibration of the pump 5 or the motor 6 is minimized.

As is clear from the foregoing description, in the spray K3, the first cover support 126 is provided at the substantially central portion of the rear face of the spray casing 1 and at the coupling portion between the split half portions 1A and 1B of the spray casing 1 so as to be embraced, at the opposite sides, by the opposed inner side faces 133. Accordingly, in accordance with the present invention, it becomes possible to improve the coupling strength of the split half portions 1A and 1B at the central portion of the spray casing 1, at which central portion it is difficult to couple the split half portions 1A and 1B with each other by using screws.

Furthermore, in accordance with the present invention, since the battery cover 115 is provided at the bottom portion of the spray casing 1 so as to confront the tank 2, the battery cover 115 is least likely to be subjected to physical and environmental damage.

Moreover, in accordance with the present invention, since the battery cover 115, i.e., the coupling means for coupling the split half portions 1A and 1B at the central portion of the spray casing 1, is not readily detached from the spray casing 1, the split half portions 1A and 1B are coupled with each other securely and reliably.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electric spray comprising:

a spray casing which accommodates therein a pump and a motor for driving said pump and is provided with a grip;

said grip being formed with a recess extending in a longitudinal direction of said grip;

a tank which is mounted on said spray casing;

a nozzle member which is connected, through a tube, with a discharge portion of said pump so as to be detachably fitted into said recess; and a slide switch for effecting on-off control of power supply to said motor, which is slidably mounted on said grip so as to be slid in the longitudinal direction of said grip;

said slide switch being formed with a hollow for receiving said nozzle member;

said slide switch, when said nozzle member has been received by said hollow, being at least partially exposed outwardly.

2. An electric spray as claimed in claim 1, wherein said motor is actuated by an interchangeable battery and an interchange opening for allowing interchange of said interchangeable battery is formed on a wall of said spray casing, with said wall confronting said tank.

3. An electric spray as claimed in claim 1, wherein said nozzle member is formed with an engageable portion and said slide switch is formed with a mating engageable portion engageable with said engageable portion, whereby when said nozzle member has been received by said hollow, said engageable portion is brought into engagement with said mating engageable portion such that said nozzle member and said slide switch are moved in one unit.

4. An electric spray as claimed in claim 1, wherein said grip is constituted by two grip portions split in the longitudinal direction of said grip and said slide switch is formed with a retainer portion for retaining said nozzle member such that said nozzle member is retained by said retainer portion when said nozzle member has been received by said hollow.

5. An electric spray as claimed in claim 2, further including a cover for covering said interchange opening, said spray casing being constituted by two casing portions, said two casing portions being, respectively, formed with first and second cover support portions such that a cover support for supporting said cover is formed by said first and second cover support portions, said cover support being embraced, at opposite sides thereof, by said cover when said cover has been mounted on said spray casing.

6. An electric spray as claimed in claim 1, further including a tubular member, said tube being made of flexible material, said tubular member being fitted, through said tube, around said discharge portion of said pump and being brought into engagement with said spray casing.

7. An electric spray as claimed in claim 1, further including a tube guide member for drawing said tube out of said spray casing, which is formed with a through-hole for receiving said tube, said spray casing being constituted by two casing portions such that a tube outlet is formed, at a coupling portion between said two casing portions, on said spray casing, said spray casing being formed, at opposite sides of said tube outlet, with a pair of retainer members such that said retainer members are disposed at said two casing portions, respectively, said tube guide member being fitted in said tube outlet through engagement of said tube guide member with said retainer members.

* * * * *